United States Patent [19]

Miyahara

[11] 3,993,052

[45] Nov. 23, 1976

[54] MASSAGE TREATMENT DEVICE

[76] Inventor: Kazuo Miyahara, 432, Nasecho, Totsuka, Yokohama, Japan

[22] Filed: Nov. 5, 1975

[21] Appl. No.: 629,629

[30] Foreign Application Priority Data

Aug. 7, 1975 Japan ..... 50-96838

[52] U.S. Cl. ..... 128/46

[51] Int. Cl.[2] ..... A61H 7/00

[58] Field of Search ..... 128/44–50, 128/24.2, 33

[56] References Cited

UNITED STATES PATENTS

| | | | |
|---|---|---|---|
| 1,931,849 | 10/1933 | Matson | 128/45 |
| 2,038,846 | 4/1936 | Matson | 128/46 UX |
| 2,232,493 | 2/1941 | Stuckey et al. | 128/46 X |

FOREIGN PATENTS OR APPLICATIONS

| | | | |
|---|---|---|---|
| 221,983 | 9/1924 | United Kingdom | 128/45 |

*Primary Examiner*—Lawrence W. Trapp
*Attorney, Agent, or Firm*—Armstrong, Nikaido & Wegner

[57] ABSTRACT

A massage treatment device including; an electric motor and reduction gear being mounted in a casing of the body proper of the device; a gear casing disposed adjacent to the casing of the body proper; a first gear-mounting member directly coupled to an output shaft of the reduction gear, which projects within the gear casing from the casing of the body proper; a first gear fixedly mounted on the first gear-mounting member; three gear-mounting members journaled in respective bearings provided in the gear casing in parallel relation to the first gear-mounting member; other three gears fixedly mounted on the three gear-mounting members, respectively, the first gear and the other three gears being arranged in a circle in meshing relation to adjacent gears, thereby constituting a circular gear arrangement; four swivel bearings attached to the outer wall of the gear casing in the positions located on the extension lines of the center axes of respective gears; eccentric, engaging holes provided eccentrically in the gear-mounting members, respectively, with one engaging hole of one gear-mounting member angularly deviated by 90° from other engaging hole of the adjacent gear-mounting members; four operating rods journaled in the swivel bearings, respectively and each having the lower end fitted in engaging relation in each eccentric, engaging hole; and cap members fitted on the top ends of respective operating rods and made of a rubbery material; the first gear being rotated by the electric motor, thereby causing a rhythmic movement of the cap members covering the top ends of respective operating rods, the rhythmic movement consisting of a given cycle of circular motions of respective cap members.

4 Claims, 3 Drawing Figures

MASSAGE TREATMENT DEVICE

BACKGROUND OF THE INVENTION

This invention relates to a massage treatment device, which is capable of applying a rational massage treatment to a human body for curing a lump of stiffened muscle which may be given birth to in the motor nerve muscle of the human body, thus curing a patient of various diseases in an early stage.

The motor nerve muscles run in the human body from top to toe, and governs various motions of a human being and a contractile motion or vermicular motion of internal organs. In parallel with the motor nerve muscles, blood vessels run all over the human body. In the event that a lump of stiffened muscle is given birth to in any of the motor nerve muscles, if the number of such a lump of stiffened muscle increases or if such a lump is grown up, then the lump of stiffened muscle will press hard the blood vessel running in the vicinity thereof, resulting in the failure in the smooth flow of blood in the blood vessel. This incurs various diseases.

For curing a human being of various diseases completely, it is essential to remove a lump of stiffened muscle, which is causes for various diseases, by resorting to any suitable means such as massaging. Yet there has never existed a proper massage treatment device which is capable of applying a rational massage treatment to the human body for positively removing a lump of muscle which is given birth to in the motor nerve muscle of the human body.

SUMMARY OF THE INVENTION

It is accordingly an object of the present invention to provide a novel massage treatment device which is capable of applying a rational massage treatment to a human body for positively removing the lump of muscle which may be given birth to in the motor nerve muscle of the human body.

According to the present invention, there is provided a massage treatment device which comprises; an electric motor; a reduction gear connected to the electric motor, said electric motor and said reduction gear being mounted in a casing of the body proper of the device; a gear casing disposed adjacent to the casing of the body proper; a first gear fixedly mounted through the intermediary of a first gear-mounting member on an output shaft of the reduction gear, which projects in the interior of the gear casing from the casing of the body proper; other three gear-mounting members journaled in respective bearings attached to the gear casing in parallel relation to the first gear-mounting member; other three gears fixedly mounted on the other three gear-mounting members, respectively, said first gear and other three gears being arranged in a circle in meshing relation to adjacent gears, thereby constituting a circular gear arrangement; four swivel bearings attached to the cover of the gear casing in the positions on the extension lines of the axes of respective gears; eccentric, engaging holes provided eccentrically in the gears or gear-mounting members, respectively, with one engaging hole of one gear or gear-mounting member angularly deviated by 90° from other engaging hole of the adjacent gears or gear-mounting member; four operating-rods journaled in the swivel bearings and each having the lower end fitted in engaging relation in each eccentric engaging hole; and caps fitted on the top ends of respective operating rods and made of a rubbery material; the first gear being rotated by the electric motor, thereby providing a given cycle of rhythmic movement to the cap members covering the top ends of respective operating rods.

It is another object of the present invention to provide a massage treatment device, wherein a rational massage treatment is applied to a human body for positively removing a lump of muscle which may be given birth to in the motor nerve muscles of the human body, thereby removing causes for various diseases promptly.

DESCRIPTION OF THE PREFERRED EMBODIMENT

Figure 1:
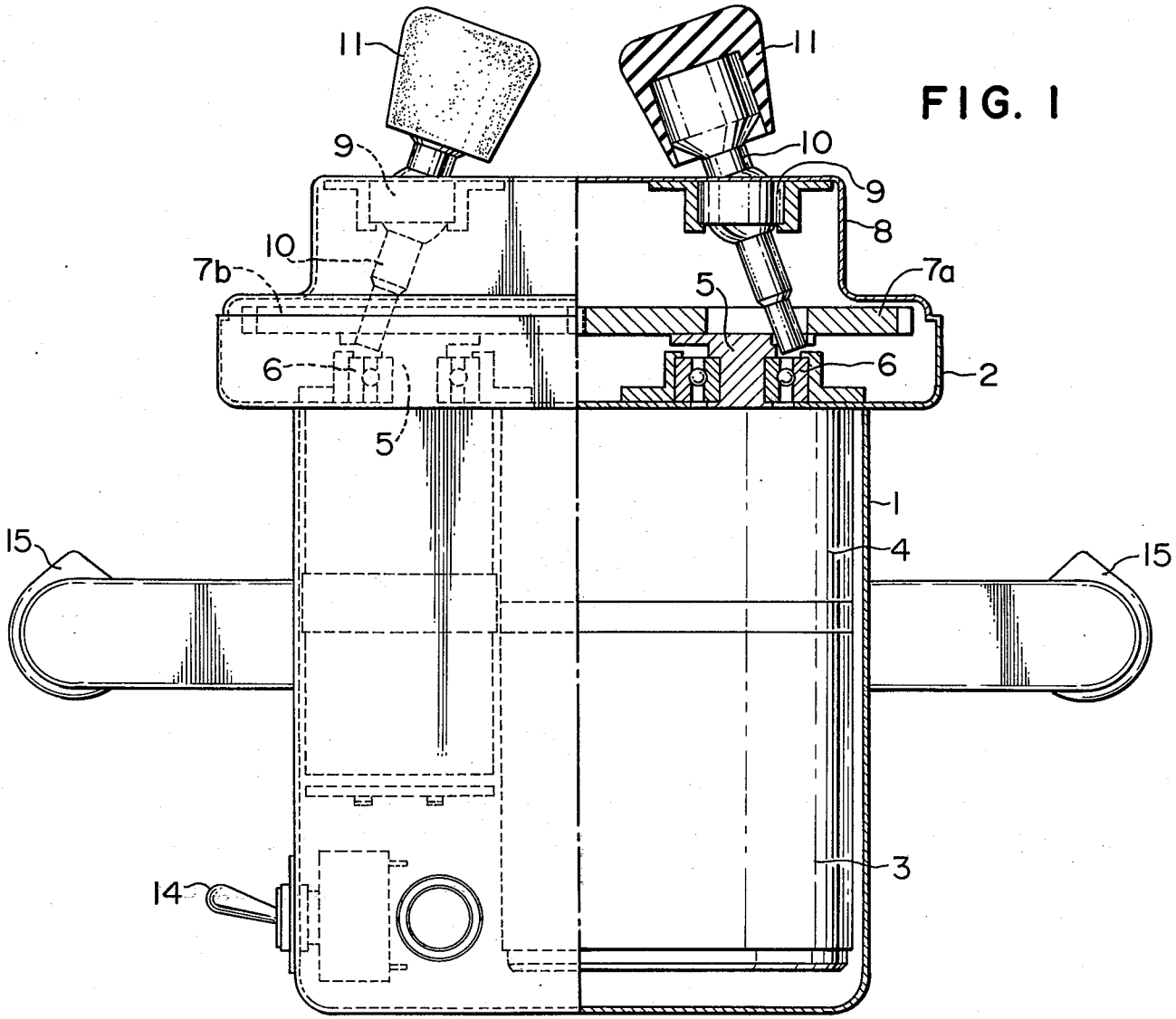
FIG. 1 is a fragmentary longitudinal cross sectional side elevational view of a massage treatment device of the present invention.
Figure 2:
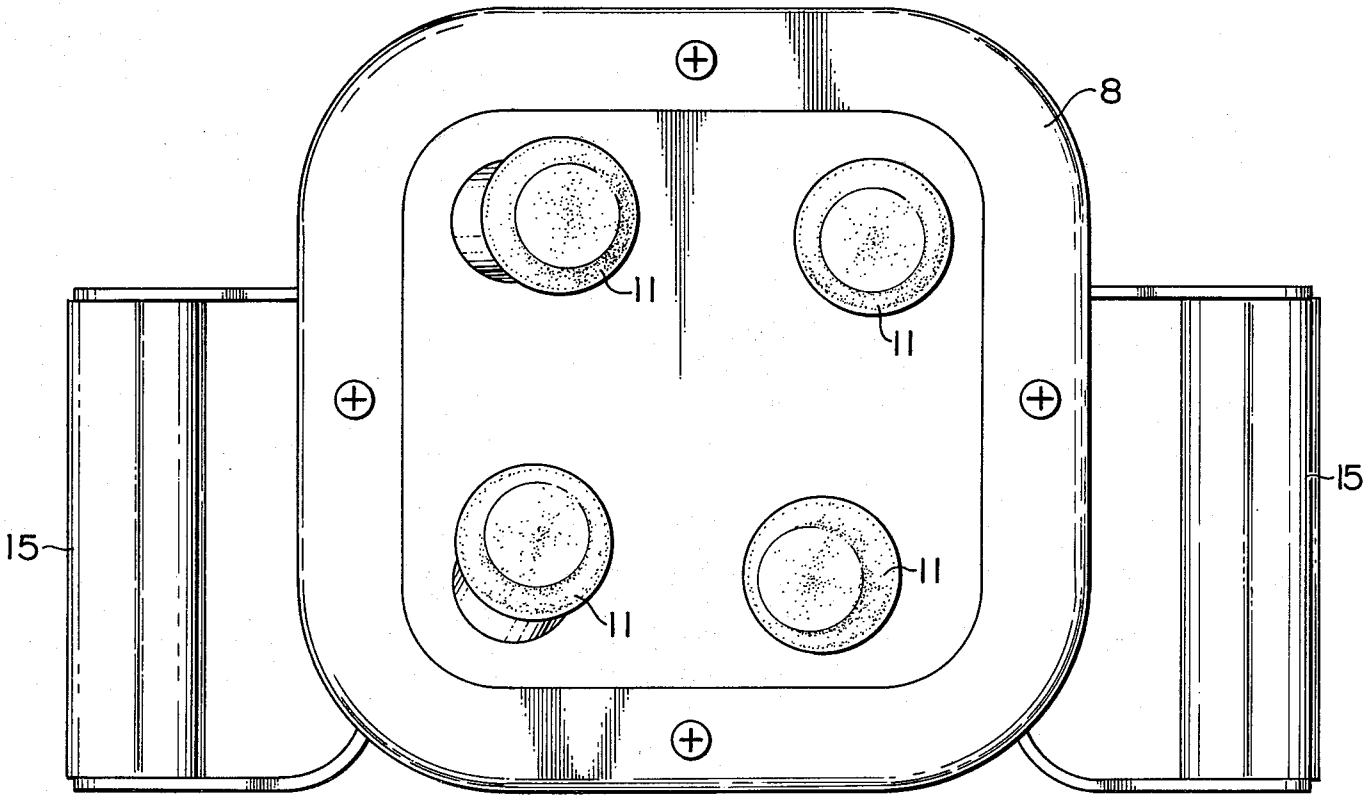
FIG. 2 is a top plan view of the massage treatment device of FIG. 1.

Referring to the drawings, shown at 1 is a casing of the body proper of the massage treatment device, which includes therein an electric motor 3 and a reduction gear 4 directly coupled to the electric motor. A gear casing 2 is provided on the top of the casing 1 integrally therewith. Projecting in the interior of the gear casing 2 is an output shaft of the reduction gear, to which is attached a gear-mounting member 5. A first gear **7*a*, normally a spur gear, is ridid with the gear-mounting member 5. Designated 6 is a bearing which is attached to the gear casing for rotatably supporting the gear-mounting member 5**.

Figure 3:
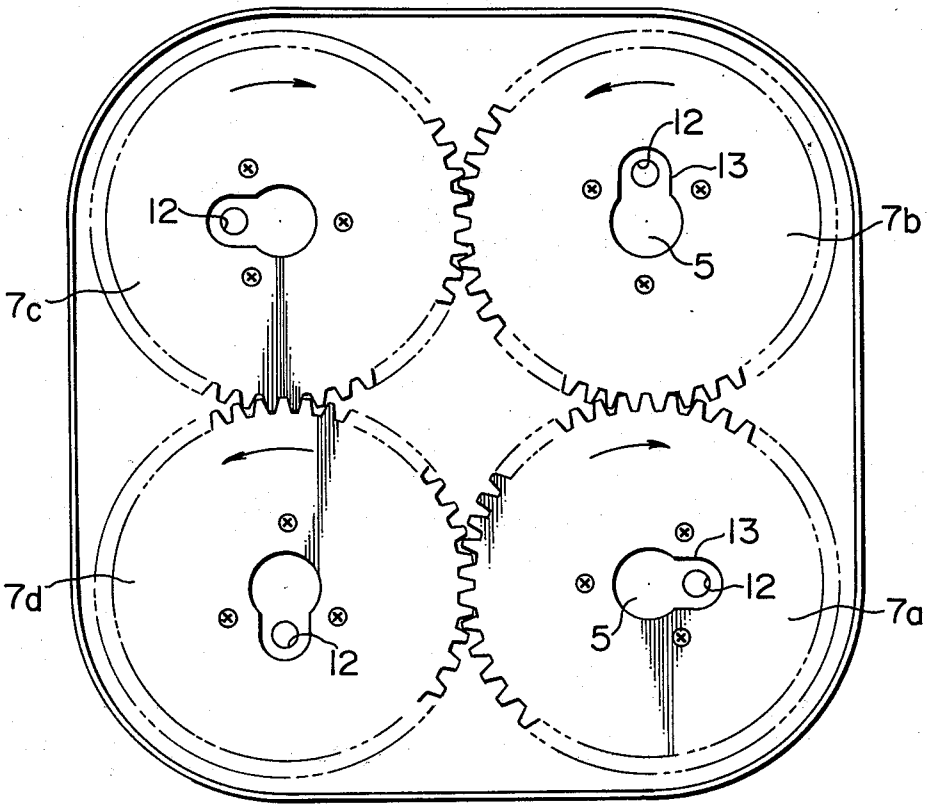
FIG. 3 is a plan view of the massage treatment device, shown with a gear casing and operating rods removed.

In the gear casing, there are provided three gears **7*b*, 7*c* and 7*d* which are of the same type as the first gear 7*a* and arranged in a circle, in combination with the first gear, in meshing relation to adjacent gears. The arrangement of these gears is best seen in FIG. 3. These other three gears 7*b*, 7*c* and 7*d* are fixedly secured to gear-mounting members 5 which are journaled in the bearings 6 perpendicularly thereto, which bearings 6 in turn are attached to the bottom wall of the gear casing 2**.

Secured to the top of the gear casing 2 is a cover 8, to which swivel bearings 9 are attached in the positions located on the extension lines of axes of the four gears consisting of the first gear **7*a*, and other three gears 7*b*, 7*c* and 7*d***.

Designated 10 are four operating rods, which are supported by the four swivel bearings 9, respectively. Cap members 11 of a rubbery material are fitted on the top ends of respective operating rods, respectively.

Shown at 12 are eccentric, engaging holes which are provided eccentrically in the gear-mounting members 5 of the gears **7*a*, 7*b*, 7*c* and 7*d***, respectively. The positional relationship among four eccentric, engaging holes is such that one engaging hole of one gear-mounting member is angularly deviated by 90° from the other eccentric, engaging hole of the adjacent gear-mounting member.

Designated 13 are cuts which are provided in respective gears **7*a*, 7*b*, 7*c* and 7*d* in a manner to run from the center of gear in the direction of the eccentricity of respective eccentric, engaging holes 12**.

Respective operating rods 10 journaled in respective swivel bearings extend through the holes 13 of the gears 7*a* through 7*d*, to thereby fit their lower ends in respective eccentric, engaging holes 12 in engaging relation thereto.

Shown at 14 is a switch for starting or interrupting rotation of the electric motor 3, and at 15 handles attached to the side walls of the casing 1 of the body proper.

For four gears 7*a* through 7*d*, spur gears having the same number of teeth are used in the embodiment shown. However, helical gears may be used. These gears 7*a* through 7*d* are rigid with the gear-mounting members 5, in a manner that the eccentric, engaging holes 12 provided in the gear-mounting members 5 may be provided in these gears. Furthermore, respective gears 7*a* through 7*d* and respective gear-mounting members 5 may integrally formed.

In operation, if the switch 14 is thrown to connect the electric motor 3 to a power source, to thereby rotate the motor, then respective gears 7*a* through 7*d* will rotate at a properly decelerated speed in the directions shown by arrows in FIG. 3, respectively. The rotation of these gears causes uniform circular motions of the rubbery cap members covering the top ends of the four operating rods 10 about respective swivel bearings 9, while an angular deviation of one cap member from the adjacent cap members is maintained at 90° and respective cap members are maintained inclined at a given angle.

In practice, an user holds the handles 15 of the device in a manner that the cap members 11 effecting the uniform circular motions described may press on a portion of his body, in which a lump of stiffened muscle appears in the motor nerve muscle. Thus, the lump of stiffened muscle will rationally, positively and promptly be cured or removed by the rhythmic kneadng and massaging actions of respective rubber cap members 11. The massage treatment device of the present invention is extremely effective for curing a patient suffering from various serious diseases in an early stage.

What is claimed is:

1. A massage treatment device characterized in that said device comprises;

an electric motor;

a reduction gear directly coupled to said motor, said electric motor and said reduction gear being mounted on a casing of the body proper of the device;

a gear casing provided adjacent to said casing of the body proper;

a first gear coupled to an output shaft of said reduction gear and journaled to one of bearings attached to said gear casing, said output shaft projecting in the interior of said gear casing;

other three gears journaled in other three bearings attached to said gear casing, in axially parallel relation to said first gear, said other three gears, together with said first gear, being arranged in a circle in meshing relation to adjacent gears, thereby constituting a circular gear arrangement;

four swivel bearings attached to the outer wall of said gear casing in the positions on the extension lines of axes of respective gears;

eccentric, engaging holes provided eccentrically in respective gears, with one engaging hole of one gear angularly deviated at 90° from the other engaging hole of the adjacent gear;

four operating rods journaled in said swivel bearings, respectively and having the lower ends fitted in engaging relation in said eccentric engaging holes, respectively; and, rubber cap members fitted on the top ends of respective operating rods;

said electric motor being rotated by said first gear, thereby providing a rhythmic movement consisting of a combination of a given cycle of circular motions of respective cap members.

2. A massage treatment device as defined in claim 1, wherein said respective gears are journaled through the intermediary of gear-mounting members in said bearings; said eccentric, engaging holes being provided in said gear-mounting members, respectively; and holes being provided in said respective gears, whereby said operating rods extend through said holes in a manner to bring their lower ends into engaging relation to said eccentric engaging holes, respectively.

3. A massage treatment device as defined in claim 1, wherein said respective gears are spur gears having the same number of teeth.

4. A massage treatment device as defined in claim 1, wherein said respective gears are helical gears having the same number of teeth.

* * * * *